US005699864A

United States Patent [19]

Dvorak et al.

[11] Patent Number: 5,699,864

[45] Date of Patent: Dec. 23, 1997

[54] MARINE ANCHORING APPARATUS

[76] Inventors: Ryan T. Dvorak, 3670 N. Moorpark Rd., Thousand Oaks, Calif. 91360; Richard T. Dvorak, 2991 Molly Ct., Newbury Park, Calif. 91320

[21] Appl. No.: 631,068

[22] Filed: Apr. 12, 1996

Related U.S. Application Data

[63] Continuation-in-part of Ser. No. 505,467, Jul. 21, 1995, abandoned.

[51] Int. Cl.[6] ..... B25D 1/04; B25D 1/14

[52] U.S. Cl. ..... 173/91; 173/128; 173/132

[58] Field of Search ..... 173/90, 91, 126, 173/128, 132; 81/489; 227/147

[56] References Cited

U.S. PATENT DOCUMENTS

| | | | |
|---|---|---|---|
| 716,274 | 12/1902 | Pierce, Jr. | 173/91 |
| 1,365,857 | 1/1921 | Seder | 173/132 |
| 2,629,985 | 3/1953 | McDowell | 173/91 |
| 2,759,486 | 8/1956 | Pesaturo | 173/91 X |
| 2,934,984 | 5/1960 | Woodman | 173/91 |
| 2,941,429 | 6/1960 | Mason | 173/91 |
| 3,381,763 | 5/1968 | Matson | 173/91 |
| 3,519,234 | 7/1970 | Matson | 173/91 |
| 3,712,389 | 1/1973 | Smoak | 173/126 |
| 3,774,361 | 11/1973 | Tanner | 52/162 |
| 3,823,785 | 7/1974 | Toliver | 173/90 |
| 4,101,088 | 7/1978 | Stauth | 173/91 X |
| 4,261,424 | 4/1981 | Gonterman et al. | 173/91 |
| 4,291,495 | 9/1981 | Crippen | 47/23 |
| 4,572,545 | 2/1986 | Dooley, Jr. et al. | 280/821 |
| 4,624,323 | 11/1986 | Burrola | 173/90 |
| 4,941,232 | 7/1990 | Decker et al. | 81/489 X |
| 4,960,064 | 10/1990 | Mestas et al. | 173/132 X |
| 5,134,008 | 7/1992 | Alm | 81/489 X |
| 5,294,152 | 3/1994 | Jacobs | 280/821 |
| 5,613,458 | 3/1997 | Owen | 173/90 |

*Primary Examiner*—Joseph J. Hail, III
*Assistant Examiner*—Jay A. Stelacone
*Attorney, Agent, or Firm*—Jack C. Munro

[57] ABSTRACT

An elongated stake having a sharply pointed lower end and a polygonal shaped upper end. A hammer is slidably mounted on the stake and is limited in its travel by an upper abutment located at the upper end and a lower abutment located about midway between the upper end and the lower end. Mounted at the upper end is a first tie down ring with a second tie down ring being mounted at the lower abutment with these tie down rings facing in opposite directions. Repeatedly impactingly moving of the hammer against the lower abutment will result in the lower end of the stake to be driven into a supporting surface. A resilient cover is mounted about the hammer which includes a strap to enclose the user's hand preventing injury to the user during hammer usage. A separate tent stake is to be engageable with the upper end and repeated impacting movements of the hammer against the upper abutment is to result in driving of the tent stake into a supporting surface.

9 Claims, 4 Drawing Sheets

66
68
82
74
76
90
156
86
70
94
11
92
88
98
78
84
162
80
96
100
72
102
106
104
13
16
124
114
120
108
112
118
122
110

MARINE ANCHORING APPARATUS

REFERRAL TO PRIOR APPLICATION

This application is a continuation-in-part of application Ser. No. 08/505,467, filed Jul. 21, 1995, now abandoned, by the same title and same inventor.

BACKGROUND OF THE INVENTION

1) Field of the Invention

The field of this invention relates to a manually operable apparatus which is to be used to drive a boat anchor into the ground without the aid of additional and separate tools, and also can be used for the purpose of driving tent stakes into the ground without the aid of additional and separate tools.

2) Description of the Prior Art

The use of manually operable devices, that are called slide hammers for driving posts into the ground, have long been known. Boats frequently come ashore to areas where there is not located a structure to facilitate tying down of the boat. Common such structures would be a rock, a plurality of rocks, a log or a tree. A common form of tying down is to take a conventional marine anchor and embed it as best as possible within a sandy beach or some other loose soil shoreline. However, upon the boat encountering any significant amount of wind, the boat will almost assuredly be released from its mooring which can result in damage or loss of the boat.

One problem in the past with slide hammers has been that once they are installed to moor a boat and the boat is left unattended, the slide hammer is subject to theft. Generally the slide hammer is a reasonable expensive purchase and therefore its loss requires an expensive replacement. Also, the boat which is moored by the slide hammer is permitted to just float away and is also subject to loss or damage. It would be desirable to find a way to use a slide anchor to anchor a boat, but where the slide anchor itself did not remain embedded within the ground so that it can be removed and stowed away in a safe place, thereby preventing the theft of the slide anchor.

Prior art driving devices have normally been designed for a single purpose. It would be desirable to have a driving device to not only be used as a boat anchor, but could also be used for other useful purposes such as driving tent stakes.

SUMMARY OF THE INVENTION

An anchor for a boat which is constructed to include an elongated, rigid, preferably metal stake which has a sharply pointed lower end and an upper end formed into a head which is polygonal shaped. Fixedly mounted on this stake directly adjacent the head is an upper abutment with a lower abutment being also fixedly mounted on a stake some distance spaced from the upper abutment and also some distance spaced from the sharp pointed lower end of the stake. Slidably mounted on the stake between the upper abutment and the lower abutment is a hammer. This hammer can be manually grasped and repeatedly impacted against the lower abutment to cause penetration of the sharp pointed lower end of the stake into soil or sand. Also fixedly mounted on the stake directly adjacent both the upper abutment and the lower abutment are tie down rings. A finned attachment can be mounted in conjunction with the stake located between the lower abutment and the sharp pointed end of the elongated stake with this finned attachment to provide securement for the stake to be used in conjunction with sand or loose soil. One the finned attachment is installed within the ground, the installing stake and hammer can be removed and replaced by an attaching stake which includes a tie down ring. This attaching stake is to be locked to the finned attachment. The attaching stake may be separately driven into the ground. A tent stake having a polygonal shaped opening in its head is to connect with the polygonal shaped head in a close fitting manner. The anchoring apparatus can then be turned upside down with the hammer to be slidingly impacted against the upper abutment which will result in penetration of the tent stake within a supporting surface. When the tent stake or attaching stake has been fully installed, the head is disengaged from the tent stake.

A primary objective of the present invention is to create the most versatile on-shore anchorage system available providing a secure tie-off location from the sandiest beach to the hardest packed soil for a personal watercraft to a large houseboat.

Another objective of the present invention is to provide a compact anchoring apparatus which can be carried within a boat which can be utilized to form a secure anchoring structure on a beach or other shoreline with conditions from hard pack soil to soft sand without requiring the aid of additional and separate tools.

Another objective of the present invention is to provide a solid anchoring device useful for houseboats, boats, personal watercraft, tents, canopies, tarps, awnings, recreational vehicles, mobile homes and in rescue operations.

Another object of the present invention is to provide a multi-purpose tool for driving, hammering, pulling and prying.

Another objective of the present invention is to construct an anchoring apparatus which can be manufactured at a reasonable cost and thereby sold to the ultimate consumer at a reasonable cost.

Another objective of the present invention is to construct a marine anchoring apparatus which can be installed within a very short period of time, even by people with minimal physical strength.

Another objective of the present invention is to provide an anchoring apparatus that once installed within the ground, only a small portion of the anchoring apparatus is installed within the ground with the installing portion of the anchoring apparatus not being mounted within the ground, thereby not being subject to theft and making available the marine anchoring apparatus for other uses.

Another objective of the present invention is to construct the hammer in such a manner that it minimizes the possibility of injury to the user.

Another objective of the present invention is to construct an anchoring apparatus with a hammer type head which can be utilized for other purposes such as installing tent stakes, attaching stakes and driving, hammering, prying or pulling situations that may occur.

BRIEF DESCRIPTION OF TEE DRAWINGS

DETAILED DESCRIPTION OF THE PREFERRED EMBODIMENTS

Figure 1:
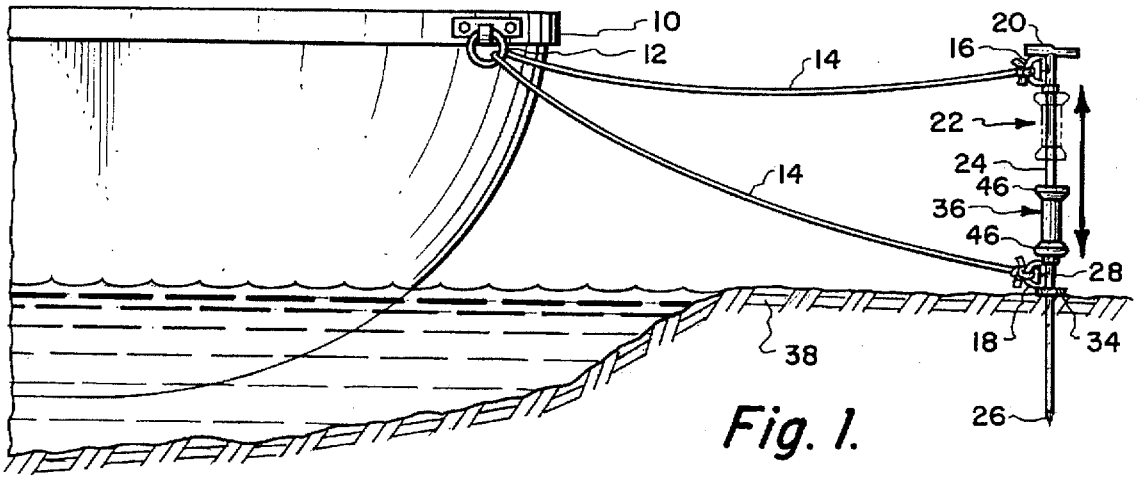
FIG. 1 is a side elevational view of the first embodiment of the marine anchoring apparatus of the present invention showing such installed on the beach or other shoreline with a boat being tied to the anchoring apparatus.
Figure 2:
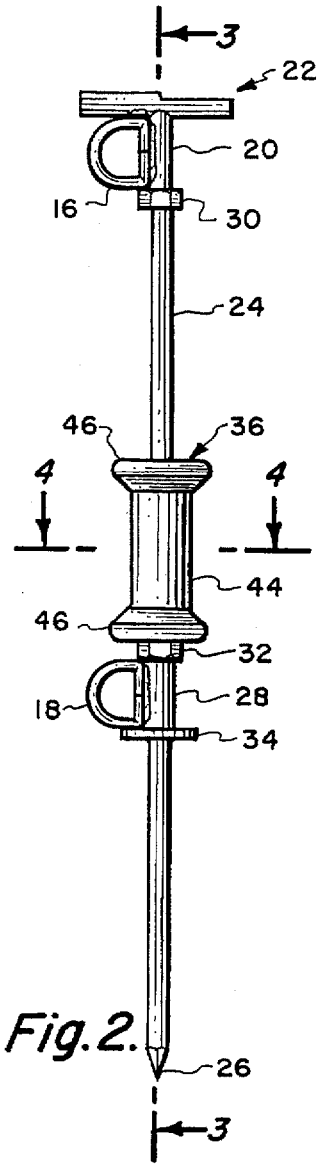
FIG. 2 is an enlarged side elevational view of the first embodiment of the marine anchoring apparatus of the present invention.
Figure 3:
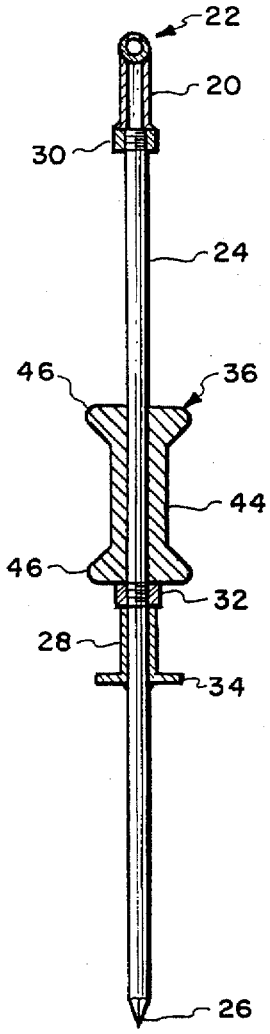
FIG. 3 is a longitudinal cross-sectional view of the first embodiment of the marine anchoring apparatus of the present invention taken along line 3—3 of FIG. 2.

Referring particularly to the drawings, there is shown a hull of a boat 10 which has mounted thereon a tie down ring 12. Extending from the tie down ring 12 are two ends of a rope 14. One end of the rope 14 is connected to tie down ring 16 with the opposite end of the rope 14 being connected to tie down ring 18. It is to be understood that it is within the scope of this invention that only one end of the rope 14 can optionally be connected to either tie down ring 16 or 18.

Tie down ring 16 is fixedly secured to the head 20 of the first embodiment of the marine anchoring apparatus 22 of this invention. The head 20 is fixedly mounted to the upper end of an elongated stake 24. The preferable material for construction of the stake 24 would normally be a metallic material such as steel. Elongated stake 24 terminates in a sharply pointed lower end 26.

The tie down ring 18 is fixedly mounted on a sleeve 28 which is also fixedly mounted to the elongated stake 24. The sleeve 28 is located a spaced distance from the sharpened end 26 and also a spaced distance from the head 20. Fixedly mounted on the elongated stake 24 directly adjacent the head 20 is an upper abutment 30. Fixedly mounted on the elongated stake 24 directly adjacent the sleeve 28 is a lower abutment 32. The lower end of the sleeve 28 terminates in an annular flange 34.

Slidably mounted on elongated stake 24 in between abutments 30 and 32 is a hammer 36. The hammer 36 comprises a weighted object usually constructed of a metallic material. In order to install the marine anchoring apparatus 22 of the present invention, it is only necessary to find an appropriate location on a shore 38 and to place the sharpened end 26 in contact with the shore 38 and then repeatedly move the hammer 36 against the abutment 32 which will cause the sharpened end 26 to penetrate the shore 38 to a predetermined depth. This predetermined depth is the distance between the sharpened point 26 and the annular flange 34. Generally this distance will be in the range of a couple feet. However, it is to be considered within the scope of this invention that this distance could be increased or decreased.

Once the sharpened point 26 is installed to the desired depth, it is only necessary for the user to install the rope 14 in between the tie down rings 12, 16 and 18 as shown in FIG. 1 of the drawings. The boat 10 is now securely moored. The boat 10 may only have a single rope 14 which would be best secured to tie down ring 18 because it is lower in height and directly adjacent to the shore 38. Therefore, the force that is created by the boat against the elongated stake 24 will create less torque tending to dislodge the stake 24 than if the rope 14 is connected to the upper tie down ring 16. The upper tie down ring 16 can then be used with a separate rope (not shown) which in turn can be installed by a separate installing stake (not shown) within the shore 38 some spaced distance from the stake 24. The second rope will function as a brace tending to prevent dislodgement of the elongated stake 24 which might tend to occur if the boat 10 is subjected to windy conditions.

At times the supporting surface of the shore 38 could comprise sand or a loose particulate type of soil. In order to achieve satisfactory securement within this type of shore 38, it is advisable to use a first finned attachment 40 which is composed of three separate fins which are mounted on a sleeve 42 with these fins being equiangularly mounted on the sleeve 42. It is the purpose of the fins of the first finned attachment 40 to provide increased surface area with the shore 38, and it is this increased area that produces the securement to keep the boat 10 securely moored to the marine anchoring device 22. The sleeve 42 is to be inserted on the stake 24 in a slidable manner so as to retain its position against the annular flange 34. A fastener (not shown) is to secure the first finned attachment 40 to the annular flange 34.

The hammer 36 comprises a necked down handle grasping area 44 terminating at opposite ends in bulbous members 46. It is the bulbous members 46 that are to be impacted against the abutments 32 and 30. Typically, the weight of the hammer 36 will be two to five pounds.

The head 20 includes an elongated slot 48. The slot 48 is closed at its inner end forming closed end 60. The slot 48 provides access into an elongated chamber 50 located within the head 20. Locatable within elongated chamber 50 is the head 52 of a threaded fastener 54. The threaded portion of the fastener 54 is to pass through the slot 48 and securely engage with the upper end of a tent stake 56. The lower end of the tent stake 56 is formed into a sharpened point 58. It is to be understood that the tent stake 56 can normally be constructed of a metallic material similar to the elongated stake 24.

Figure 7:
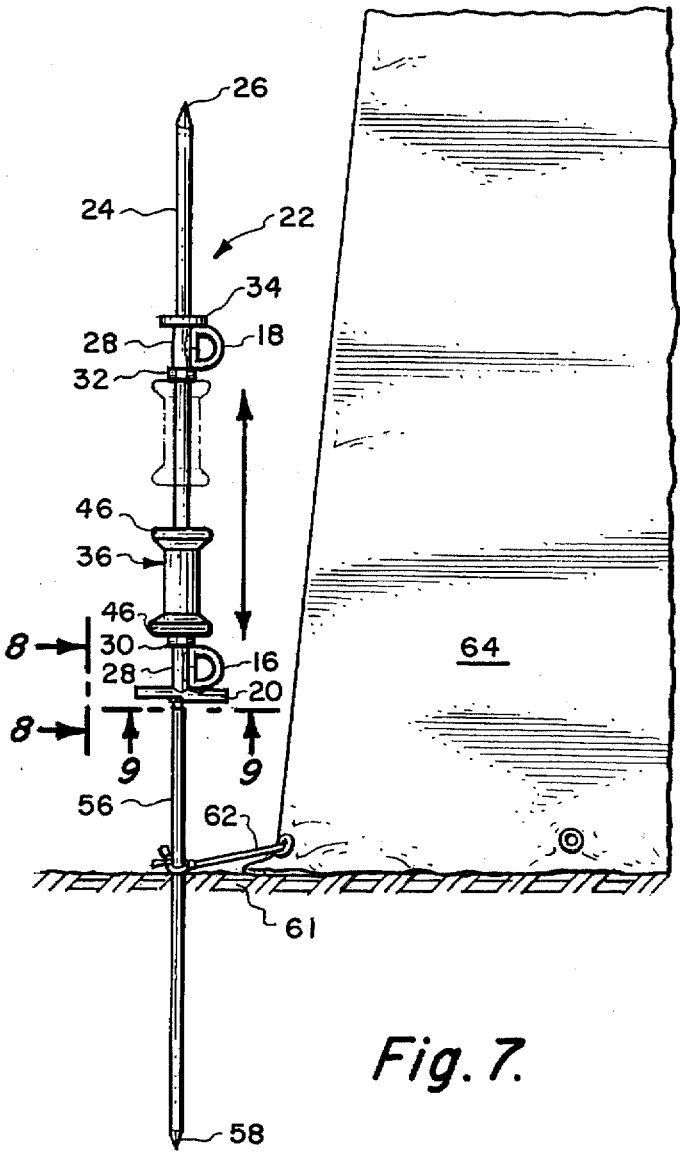
FIG. 7 is a side elevational view depicting usage of the first embodiment of the marine anchoring apparatus of the present invention to install a tent stake within ground.
Figure 9:
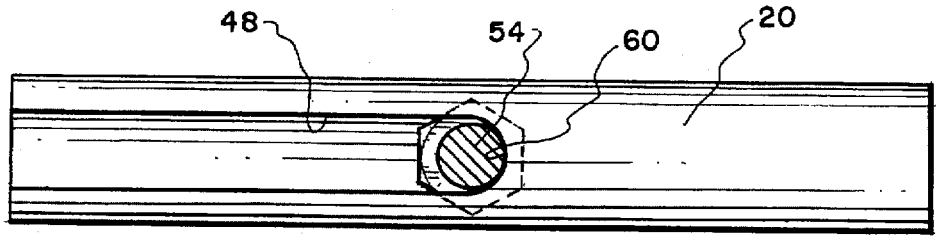
FIG. 9 is a cross-sectional view through the tent stake taken along line 9—9 of FIG. 7.

With the head 52 slidingly received within elongated chamber 50 with the threaded end 54 located directly in contact with the closed end 60 of the slot 48, the longitudinal center axis of the tent stake 56 will be in alignment with the longitudinal center axis of the elongated stake 24. The sharpened point 58 is to be located against the supporting surface 60 which generally will comprise soil. The user then grasps the necked down area 44 of the hammer 36 and repeatedly impacts the appropriate bulbous member 36 against the abutment 30. This will cause the tent stake 56 to be driven into the ground 61 as is depicted within FIG. 7 of the drawings. A tie down rope 62 of a tent 64 is to be attached to the tent stake 56.

The first embodiment of the marine anchoring apparatus 22 can be used in hard packed soil and even through asphalt. To extract the stakes 24 and 56, it is only necessary to use the hammer 36 in the reverse direction impacting abutment 30. The head 20 is shown in transverse cross section to be circular.

Referring particularly to FIGS. 10 to 16 of the drawings there is shown the second embodiment of the anchoring apparatus 66 of this invention. The second embodiment anchoring apparatus 66 is basically similar to the first embodiment 22 in that there is a head 68, a stake 70 which terminates in a sharply pointed end 72. Mounted on the stake 70 is an upper abutment 74 and a lower abutment 78. Fixedly mounted on the stake 24 between the upper abutment 74 and the head 68 is an upper sleeve 82. Fixedly mounted on the upper sleeve 82 is a first tie down ring 76. Fixedly on the stake 20 directly adjacent the lower abutment 78 is a lower sleeve 84. Fixedly mounted on the lower sleeve 84 is a second tie down ring 80.

The differences between the second embodiment 66 versus the first embodiment 22 is that the tie down rings 76 and 80 extend in opposite directions from each other. The reason for this is generally a tie down rope 92 is connected to the second tie down ring 80 with this rope 92 being connected to a boat or other type of marine vehicle. A separate rope 90 is connected to the tie down ring 76 which extends in an opposite direction from the rope 92. The rope 90 is to be connected to a bracing structure such as another stake that would be driven into the ground some spaced distance from the position of the stake 70. In this way the second embodiment 66 is braced by the rope 90.

Another difference of the second embodiment 66 from the first embodiment 22 is that the head 68, in transverse cross section, is not round, but is actually square. Any polygonal shape would be satisfactory. The reason for making the head 68 of a polygonal shape is to facilitate its connection with an installation of a tent stake which will be explained further on in the specification.

The slide hammer 98 is mounted on the stake 70. The slide hammer 98 is movable between the solid line position and the dotted line position shown in FIG. 10. It has been discovered that a user may possibly cause a finger to be located within the impacting area when using a hammer 98. To avoid possible injury to the user, the necked down area of the hammer 98 is covered with a resilient cover 86 which will normally be of a fabric such as a canvas material. The resilient cover 86 is tightly held in position on the hammer 98 by means of a hook and loop type of fastener 88 (trade name "VELCRO"). The cover 86 also includes a handle strap 94. The handle strap 94 is located so that automatically upon the placing of one's hand in conjunction with the hammer 98 that the hand will be confined by the handle strap 94. This handle strap 94 will thereby prevent any portion of the hand coming into contact with the impact area, hence preventing injury. Also, the fact that the grabbing surface of the hammer 98 includes a soft resilient covering makes it far more comfortable to use the hammer 98.

Fixedly mounted on the stake 70 located directly adjacent the tie down ring 80 is a flange 96. Mounted within the flange 96 is a hole 100. A second finned attachment 102 can be located in conjunction with the stake 70 with the flange 108 of, the second finned attachment 102 being placed directly against the flange 96. Within the flange 108 is located a hole 110. A bolt fastener 112 can be mounted between holes 100 and 110 when they are aligned with the wing nut 114 engaging with the bolt fastener 112. This will result in securely locking together the second finned attachment 102 and the flange 96. It is to be deemed optional to use the bolt fastener 112 as it is not necessary to lock together the second finned attachment 102 and the flange 96 to merely embed the second finned attachment 102 within the ground. The second finned attachment 102 is designed to be used in conjunction with loose soil. When soil is harder, then it would not be necessary to use at all the second finned attachment 102.

Figure 5:
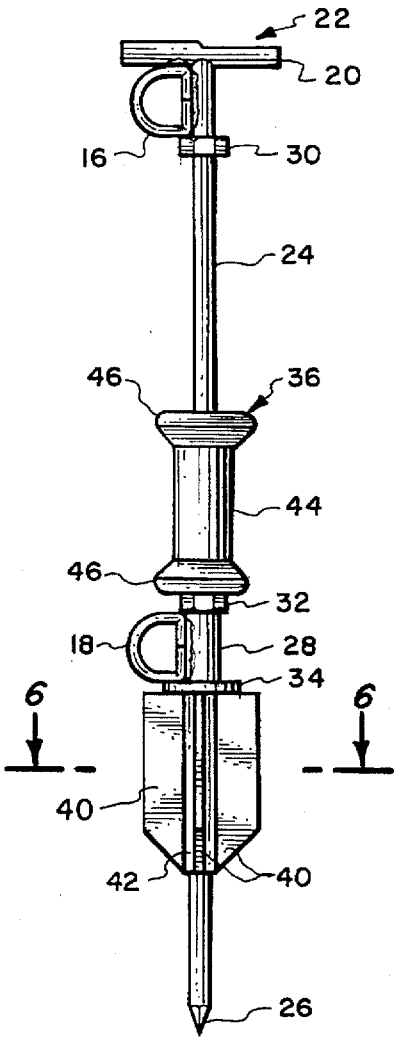
FIG. 5 is a view similar to FIG. 2 showing the addition of a first finned attachment for the purpose of installation within sandy or loose particulate soil in order to achieve a solid securement within these kinds of supporting surfaces.
Figure 4:
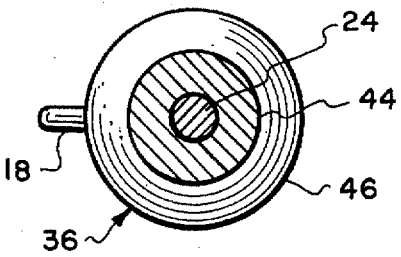
FIG. 4 is a transverse cross-sectional view through the hammer of the first embodiment of the marine anchoring apparatus of the present invention taken along line 4—4 of FIG. 2.
Figure 6:
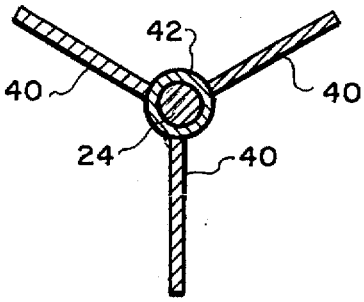
FIG. 6 is a transverse cross-sectional view through the first finned attachment taken along line 6—6 of FIG. 5.
Figure 8:
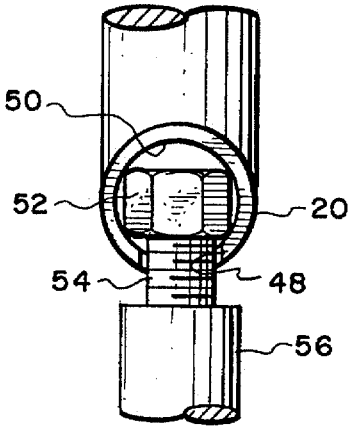
FIG. 8 is an end view of the head portion of the first embodiment of the marine anchoring apparatus when connected with the tent stake taken along line 8—8 of FIG. 7.
Figures 10, 11, 12, 13, 14, 15:
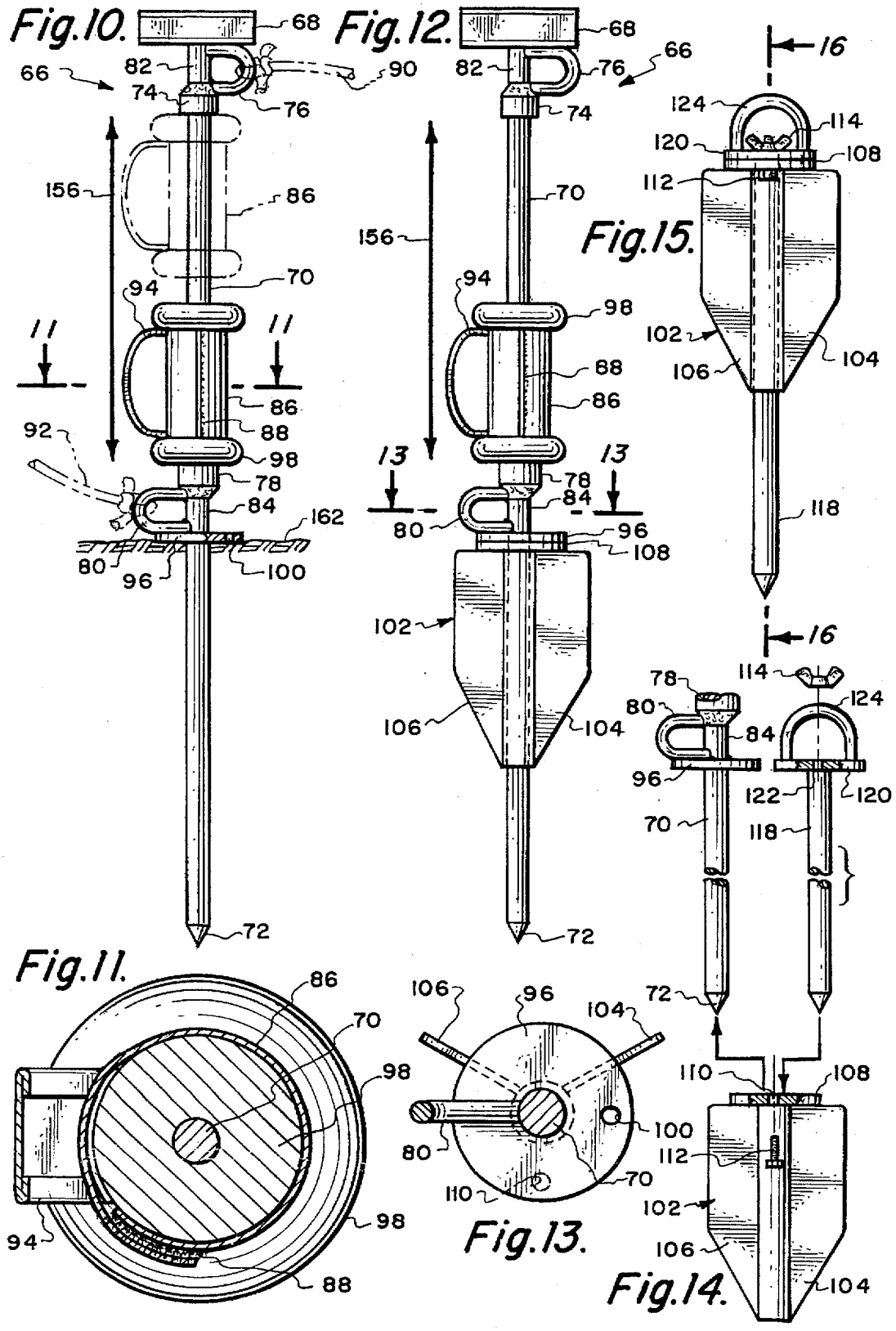
FIG. 10 is a side elevational view of a second embodiment of the marine anchoring apparatus of this invention.
FIG. 11 is a transverse cross-sectional view taken along line 11—11 of FIG. 10.
FIG. 12 is a side elevational view of the second embodiment of the marine anchoring apparatus of this invention showing connection with a second finned attachment for installation within the ground.
FIG. 13 is a cross-sectional view taken along line 13—13 of FIG. 12.
FIG. 14 is a side elevational view of the second embodiment of the marine anchoring apparatus of this invention showing disengagement of the installing structure from the second finned attachment and replacement of an attaching stake in conjunction with the second finned attachment.
FIG. 15 is a side elevational view showing the second finned attachment being connected with the attaching stake.

The second finned attachment 102 includes two in number of fins 104 and 106. It is to be noted that these fins are located about 120 degrees apart. In comparing the second finned attachment 102 with the first finned attachment used in conjunction with the first finned attachment 40 specifically shown in FIGS. 5 and 6, it can be seen that the primary difference is that the second finned attachment 102 uses only two fins where the first finned attachment 40 uses three in number of fins. It has been discovered that the third fin actually does nothing in providing of lateral support. The fins 104 and 106 are to be located so that such face toward the pulling force. In other words, the fins 104 and 106 should not be located as shown in FIG. 13 but actually located so such face tie down ring 80. When such face the tie down ring 80, the hole 110 will align with hole 100.

The second finned attachment 102 includes a center through opening 116. It is within this center through opening 116 that the stake 70 is located in order to effect the installation of the second finned attachment 102 within the loose soil. It is to be understood that this installation is caused by repeatedly moving and causing the hammer 98 to strike against lower abutment 78.

Once the second finned attachment 102 is installed within the ground, the flange 108 should be located at about the surface 162 of the ground. The stake 70 can then be removed and an attaching stake 118 then mounted in conjunction with the through opening 116 with the tip of the attaching stake 118 occupying the hole that was formed within the ground by the stake 70. In this particular position the flange 120 of the attaching stake 118 will abut against the flange 108.

Flange 120 is to include a hole 122. This hole 122 can align with the hole 110 with the bolt fastener 112 with wing nut 114 being used to lock together the attaching stake 118 and the second finned attachment 102. Mounted on the flange 120 is a tie down ring 124. This attaching stake 118 is used in lieu of the anchoring apparatus 66 after the second finned attachment 102 is installed within the ground. This will eliminate possible theft of the anchoring apparatus 66. Theft of the attaching stake 118 could occur. However, the attaching stake 118 should have little use by itself to any thief without the anchoring apparatus 66. The attaching stake 118 can be driven into the ground if necessary by the hammer 98 and stake 70.

When the ground comprises sand, it is desirable to utilize a third finned attachment 126. The third finned attachment 126 is to be connected in the same manner with the anchoring apparatus 66 and installed in the same manner by being embedded within the ground. The third finned attachment 126 includes two in number of fins 128 and 130 which again are located 120 degrees apart. Mounted on the elongated stake member 131 of the third finned attachment 126 is a flange 122. The elongated stake member 131 terminates in its bottom end into a flattened tip 134. A sharp point is not necessary as this third finned attachment 126 is being driven into sand or exceedingly loose soil. The attaching stake 118 is to be utilized and locked in conjunction with the third finned attachment 126 in the same manner as previously discussed in relation to second finned attachment 102. It is to be noted that the length of the elongated stake 131 will be greater in length than the portion of the stake 70 that extends beneath the flange 96. This relationship is clearly shown in FIG. 17.

If necessary, the entire stake 70 and hammer 98 could be used as a driver (not just the hammer 98). The user would locate hammer 98 against lower abutment 78 with one hand and then with the other hand grab head 68. The user would then lift and lower stake 70 and hammer 98 causing flange 96 to impact flange 108 on flange 132. The advantage is that instead of using three or four pounds as the driving force there is being used about thirteen pounds which certainly more quickly installs attachments 102 or 126.

Figures 16, 17, 18, 19, 20, 21, 22:
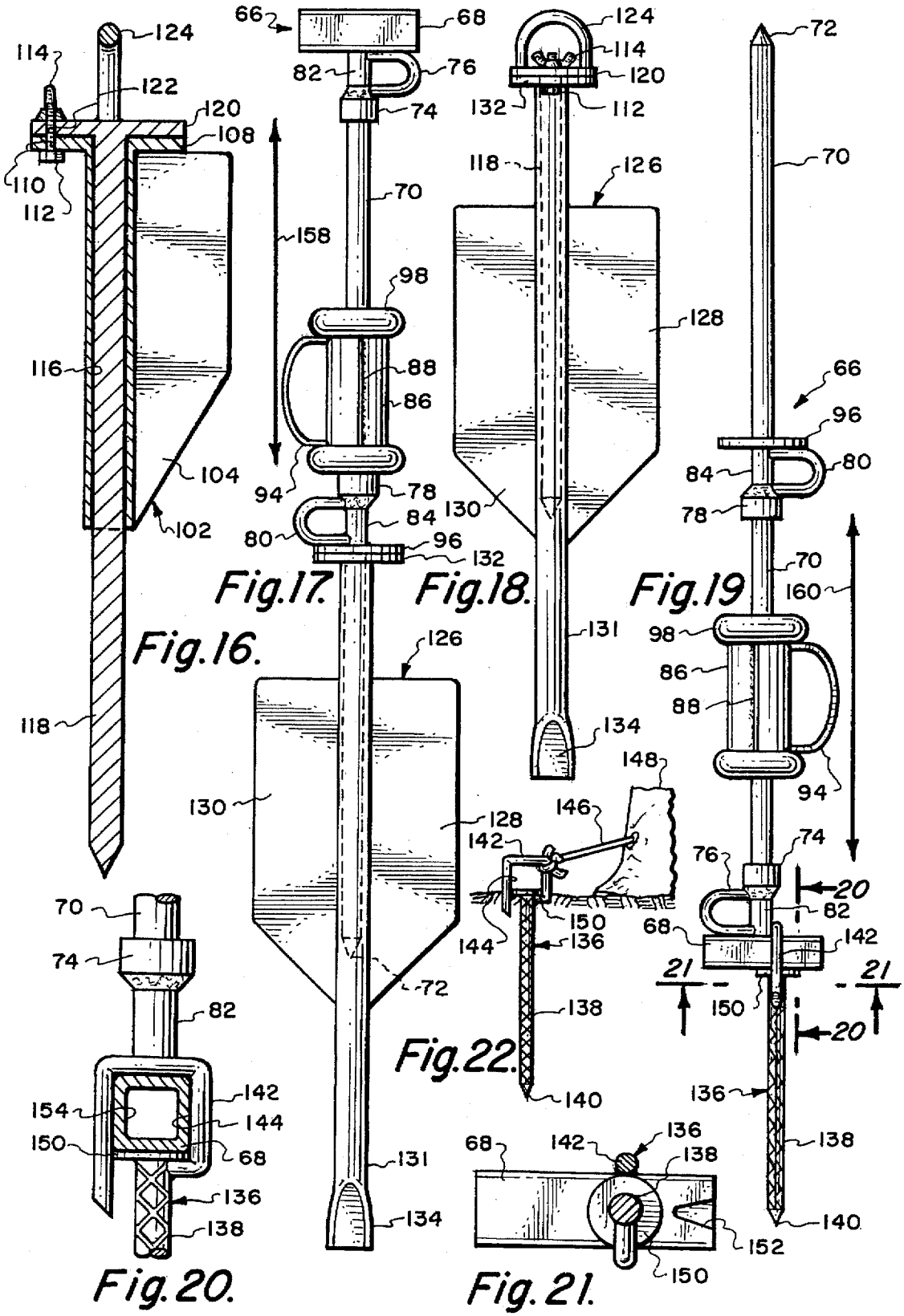
FIG. 16 is a longitudinal cross-sectional view taken along line 16—16 of FIG. 15.
FIG. 17 is a side elevational view similar to FIG. 12 but showing the second embodiment of the marine anchoring apparatus connecting with a third finned attachment which is designed primarily for use only in sand.
FIG. 18 is a view similar to FIG. 15 but showing the attaching stake being connected with the third finned attachment shown in FIG. 17.
FIG. 19 is a side elevational view showing the second embodiment of the marine anchoring apparatus of this invention being used to install specially designed tent stake.
FIG. 20 is a cross-sectional view taken along line 20—20 of FIG. 19.
FIG. 21 is a cross-sectional view taken along line 21—21 of FIG. 19.
FIG. 22 is a view depicting usage of the special form of tent stake that has been installed utilizing the second embodiment of the marine anchoring apparatus of this invention.

Referring particularly to FIGS. 19 to 22, there is shown a tent stake 136. The tent stake 136 has an elongated body 138 which terminates in a lower sharpened point 140. The upper end of the body 138 is integrally connected to a polygonal shaped head 142. The head 142 is actually formed by a rod which is bent in a manner to produce a polygonal shaped opening 144. The head 68 is locatable in a close fitting manner within the opening 144, as is depicted in FIGS. 19 and 20 of the drawings. The body 138 is oriented to be somewhat aligned with the stake 70 but with the body 138 extending in the opposite direction from the stake 70. The hammer 98 is then moved against the upper abutment 74 to cause the body 138 to penetrate the ground as is clearly shown in FIG. 22. Once the tent stake 136 is installed, a rope 146 is to be attached to the polygonal head 142 with the rope 146 being connected to a wall of a tent 148. The tent stake 135 includes a flange 150 which abuts against the head 68 as the tent stake 136 is being installed within the ground.

The head 68 may include a V-shaped slot 152. The head 68 also includes a through opening 154. The purpose of the V-shaped slot 152 is to remove nail types of fasteners by locating of the head of the nail type fastener (not shown) within the through opening 154 with the sidewall of the V-shaped slot 152 engaging with the sidewalls of the nail type of fastener. By moving of the anchoring apparatus 66 in a manner similar to a conventional crowbar, the nail can then be removed.

Arrow 156 is shown in FIGS. 10 and 12 to depict the extent of movement of the slide hammer 98. Arrow 158 is shown in FIG. 17 to again depict the length of movement of the slide hammer 98. Arrow 160 is shown in FIG. 19 to depict the extent of movement of the slide hammer 98.

What is claimed is:

1. A marine anchoring apparatus comprising:

a) a slide hammer tool, said slide hammer tool comprising:

an elongated stake having a lower end and an upper end, said lower end being sharply pointed and said upper end terminating in a transverse head;

a lower abutment fixedly mounted on said elongated stake, said lower abutment being spaced from both said upper end and said lower end;

an upper abutment fixedly mounted on said elongated stake, said upper abutment being located directly adjacent said upper end;

at least one tie down ring secured to said elongated stake;

a hammer slidably mounted on said elongated stake and located between said upper abutment and said lower abutment, whereby said hammer is to be repeatedly moved and impacted against said lower abutment to drive said elongated stake into a supporting surface securing such and then permitting securing of a tie down rope to said at least one tie down ring;

b) at least one finned attachment having a central bore configured to receive the lower end of said elongated stake;

c) at least one tent stake having an opening in an upper portion thereof, configured to receive said transverse head of said elongated stake, said hammer to be moved against said upper abutment to cause penetration of said tent stake into the supporting surface;

wherein, the lower end of said elongated stake can be driven into the supporting surface by said repeated impacting; and wherein, one of said at least one finned attachment can be received on the lower end of said elongated stake prior to the elongated stake being driven into the supporting surface, thereby permitting the slide hammer tool to be removed while the one of said at least one finned attachment remains in the supporting surface; and wherein, the upper end of said elongated stake can receive one of said at least one tent stake and said hammer is impacted against said upper abutment to drive the one of said at least one tent stake into the supporting surface and said hammer is impacted against said lower abutment to remove the one of said at least one tent stake from the supporting surface.

2. The marine anchoring apparatus as defined in claim 1, including:

a resilient cover mounted on said hammer, said resilient cover including a strap, said strap to snugly enclose a user's hand to protect the user's hand from being injured during use of said hammer.

3. The marine anchoring apparatus as defined in claim 2, wherein:

the resilient cover is mounted on said hammer with a conventional hook-and-loop-type fastener, thereby allowing said cover to be adjusted and removed.

4. The marine anchoring apparatus as defined in claim 1, and said at least one tie down ring further comprising:

a first tie down ring and a second tie down ring, said first tie down ring secured to said elongated stake at said upper end and said second tie down ring secured to said elongated stake directly adjacent said lower abutment; relative to said elongated stake, said first tie down ting extends in a direction opposite to said second tie down ring.

5. The marine anchoring apparatus as defined in claim 1, and at least one of said at least one finned attachment further comprising:

a pair of fins located a predetermined angular distance apart from one another.

6. The marine anchoring apparatus as defined in claim 1, and further comprising:

at least one attaching stake having an additional tie down ring, said at least one attaching stake having an elongated end configured for insertion into the central bore of said finned attachment;

wherein, said at least one attaching stake replaces said elongated stake in said central bore of the finned attachment after removal of said elongated stake.

7. The marine anchoring apparatus as defined in claim 6, and further comprising:

locking means to secure each of said at least one attaching stake to a respective one of said at least one finned attachment.

8. The marine anchoring apparatus as defined in claim 1, and further comprising:

locking means to secure said elongated stake to a respective one of said at least one finned attachment.

9. The marine anchoring apparatus as defined in claim 1, wherein:

said transverse head is polygonal shaped and each of said at least one tent stake has a polygonal shaped opening in an upper end thereof, said transverse head to be located within said polygonal shaped opening of one of said at least one tent stake in a close fitting manner, thereby preventing relative pivotal movement between said transverse head and the one of said at least one tent stake, said hammer to be moved against said upper abutment to cause penetration of the one of said at least one tent stake into the supporting surface.

* * * * *